US011573009B2

(12) United States Patent
Bramhane et al.

(10) Patent No.: US 11,573,009 B2
(45) Date of Patent: Feb. 7, 2023

(54) APPLIANCE LATCH ASSEMBLY

(71) Applicant: WHIRLPOOL CORPORATION, Benton Harbor, MI (US)

(72) Inventors: Ganesh Bramhane, Pune (IN); Pallavi B. Nevage, Nashik (IN); Pradeep Shankar Thorat, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 108 days.

(21) Appl. No.: 16/866,659

(22) Filed: May 5, 2020

(65) Prior Publication Data

US 2021/0348769 A1 Nov. 11, 2021

(51) Int. Cl.

| | |
|---|---|
| ***F24C 15/22*** | (2006.01) |
| ***F24C 15/02*** | (2006.01) |
| ***E05B 47/00*** | (2006.01) |
| ***E05F 1/12*** | (2006.01) |
| *E05C 19/12* | (2006.01) |

(52) U.S. Cl.

CPC ..... *F24C 15/023* (2013.01); *E05B 47/00* (2013.01); *E05F 1/12* (2013.01); *E05B 2047/0068* (2013.01); *E05C 19/12* (2013.01); *E05Y 2900/308* (2013.01)

(58) Field of Classification Search

CPC .... F24C 15/023; F24C 15/028; F24C 15/022; E05B 47/00; E05F 1/12

USPC ..... 312/409; 126/197; 292/DIG. 11

See application file for complete search history.

(56) References Cited

U.S. PATENT DOCUMENTS

| | | | | |
|---|---|---|---|---|
| 2,467,815 | A | 4/1949 | Gurtiss, Jr. | |
| 3,189,375 | A | 6/1965 | Getman | |
| 3,745,988 | A * | 7/1973 | Frick | F24C 14/02 126/273 R |
| 5,493,099 | A * | 2/1996 | McWilliams, III | H05B 6/6417 292/124 |
| 6,108,196 | A | 8/2000 | Jung | |
| 6,965,516 | B1 * | 11/2005 | Lin | G06F 1/183 361/759 |
| 6,966,582 | B1 * | 11/2005 | Malone | F24C 15/022 292/64 |
| 7,475,921 | B2 * | 1/2009 | Knoll | F24C 15/022 126/197 |
| 8,796,603 | B2 | 8/2014 | Lee et al. | |
| 9,309,693 | B2 | 4/2016 | Puscas et al. | |
| 9,556,648 | B2 | 1/2017 | Gardner et al. | |
| 2007/0296224 | A1 | 12/2007 | Courter | |
| 2015/0192304 | A1 * | 7/2015 | Turner | F24C 15/022 126/197 |

(Continued)

FOREIGN PATENT DOCUMENTS

| | | |
|---|---|---|
| JP | S5063639 U | 6/1975 |
| JP | S5067451 U | 6/1975 |
| JP | S5191344 U | 7/1976 |

*Primary Examiner* — James O Hansen

(74) *Attorney, Agent, or Firm* — Price Heneveld LLP

(57) ABSTRACT

A latch assembly for an appliance includes a cabinet having a front panel with a latch opening. A latch member is aligned with the latch opening of the front panel and is movable between an engaged position and a disengaged position. A door is hingedly coupled to the cabinet between open and closed positions and has a latch receiving aperture. A cover plate is configured to selectively cover the latch opening. The cover plate is rotatably coupled with the cabinet between first and second positions.

11 Claims, 9 Drawing Sheets

(56) References Cited

U.S. PATENT DOCUMENTS

| | | | |
|---|---|---|---|
| 2015/0233144 | A1 | 8/2015 | Puscas et al. |
| 2018/0292094 | A1 | 10/2018 | Park |

* cited by examiner

APPLIANCE LATCH ASSEMBLY

FIELD OF DISCLOSURE

The present disclosure generally relates to a latch assembly, and more specifically, to an appliance latch assembly.

BACKGROUND

Many cooking appliances include a latch assembly to couple a door with a cabinet of the appliance. The latch assembly may be configured to secure the door in a closed position when a high-heat cycle is operated.

SUMMARY OF THE DISCLOSURE

According to one aspect of the present disclosure, a cooking appliance may include a cabinet defining first and second compartments. A front panel may be coupled with the cabinet. The front panel may define an access opening in communication with the first compartment and a latch opening in communication with the second compartment. A door may be hingedly coupled with the cabinet and may be movable between a closed position and an open position. A latch assembly may be positioned within the second compartment. The latch assembly may include a latch member operable between engaged and disengaged positions. A portion of the latch member may extend through the latch opening when the latch member is in an engaged position. A cover plate may be operably coupled to the front panel at the latch opening and may be movable from a first position to a second position by the latch member when the latch member is moved from the disengaged position to the engaged position.

According to another aspect of the present disclosure, a cooking appliance may include a cabinet having a compartment and a front panel. The front panel may include a latch opening disposed therethrough. A door may be hingedly coupled with the cabinet and may define a latch receiving aperture. A latch assembly may be positioned within the compartment and may have a latch member operable between first and second positions. The latch member may extend through the latch opening when the latch member is in a second position. A cover plate may be rotatably coupled with the cabinet and may be configured to selectively obstruct the latch opening.

According to yet another aspect of the present disclosure, a latch assembly for an appliance may include a cabinet having a front panel with a latch opening. A latch member may be aligned with the latch opening of the front panel and may be movable between an engaged position and a disengaged position. A door may be hingedly coupled to the cabinet between open and closed positions and may define a latch receiving aperture. A cover plate may be configured to selective cover the latch opening. The cover plate may be rotatably coupled with the cabinet between first and second positions.

These and other features, advantages, and objects of the present disclosure will be further understood and appreciated by those skilled in the art by reference to the following specification, claims, and appended drawings.

Figure 1:
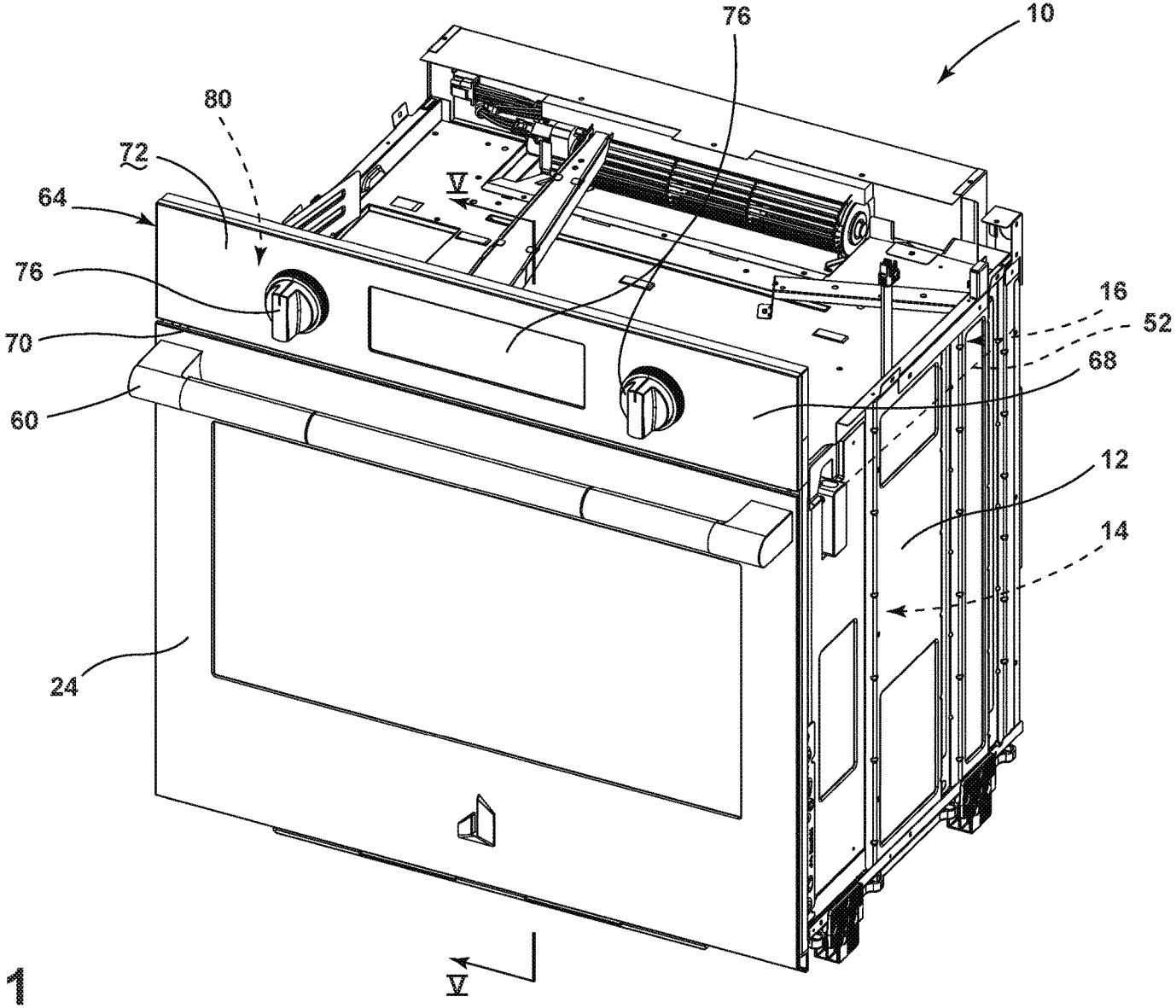
FIG. 1 is a top perspective view of a cooking appliance with an outer wrapper removed, according to various examples.

The components in the figures are not necessarily to scale, emphasis instead being placed upon illustrating the principles described herein.

DETAILED DESCRIPTION

The present illustrated embodiments reside primarily in combinations of method steps and apparatus components related to an appliance latch assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring now to FIGS. 1-6, reference numeral 10 generally designates a cooking appliance. The cooking appliance 10 includes a cabinet 12 that at least partially defines a first compartment 14 and a second compartment 16. The second compartment 16 is separated from the first compartment 14. A front panel 18 is coupled with the cabinet 12 and defines an access opening 20 in communication with the first compartment 14. The front panel 18 further defines a latch opening 22 in communication with the second compartment 16. A door 24 is hingedly coupled with the cabinet 12 and is aligned with the front panel 18 in a closed position. A latch assembly 26 is positioned within the second compartment 16. The latch assembly 26 includes a latch member 28 operably between engaged and disengaged positions. At least a portion of the latch member 28 extends through the latch opening 22 when the latch member 28 is in the engaged position. A cover plate 30 is operably coupled with the front panel 16 of the cabinet 12 at the latch opening 20 and is movable from a first position to a second position by the latch member 28 when the latch member is moved from the disengaged position to the engaged position. A proximity sensor 32 is positioned proximate the latch assembly 26 and is configured to detect when the door 24 is in the closed position.

Figure 2:
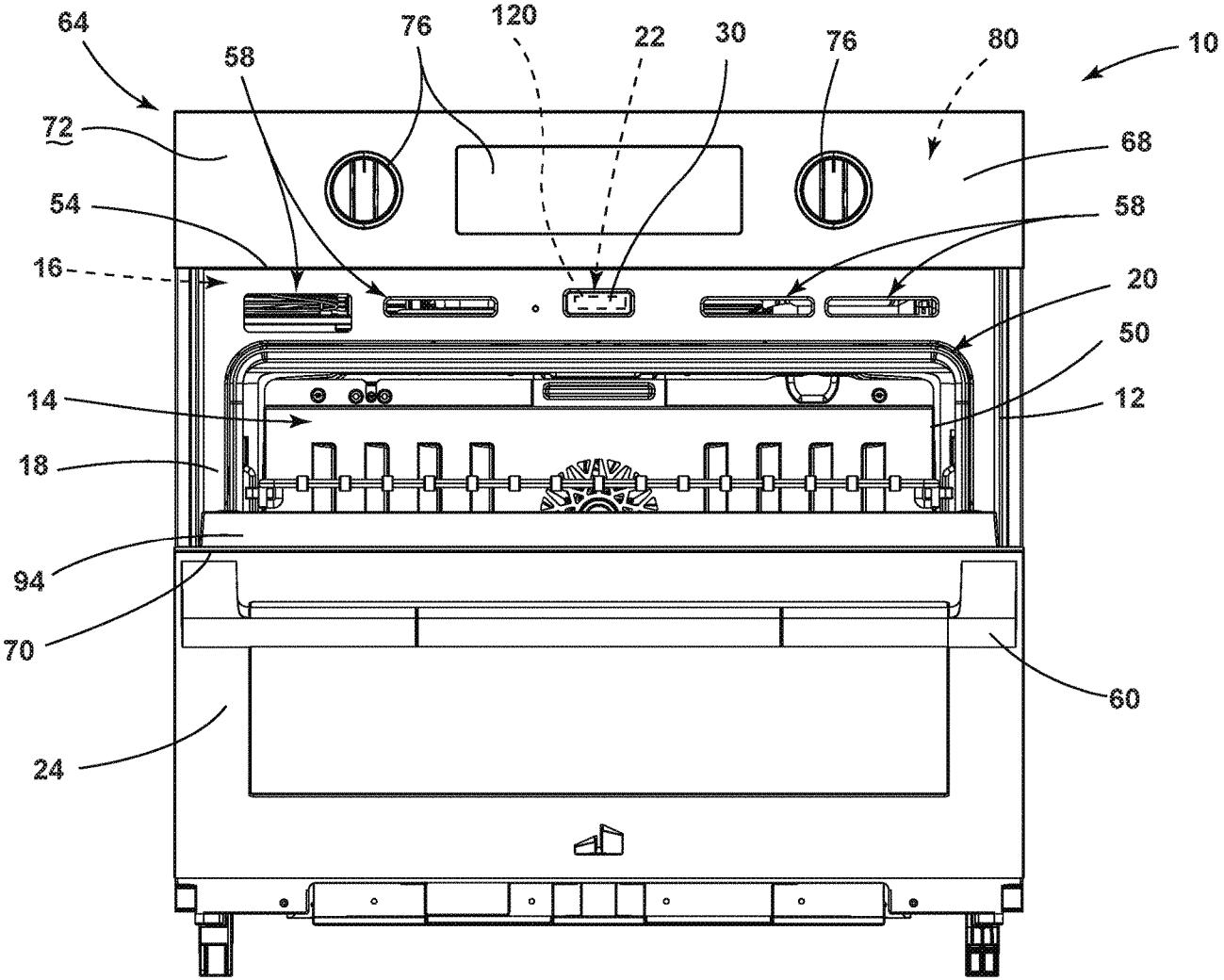
FIG. 2 is a front elevational view of the cooking appliance of FIG. 1 with a door in an intermediate position.
Figure 3:
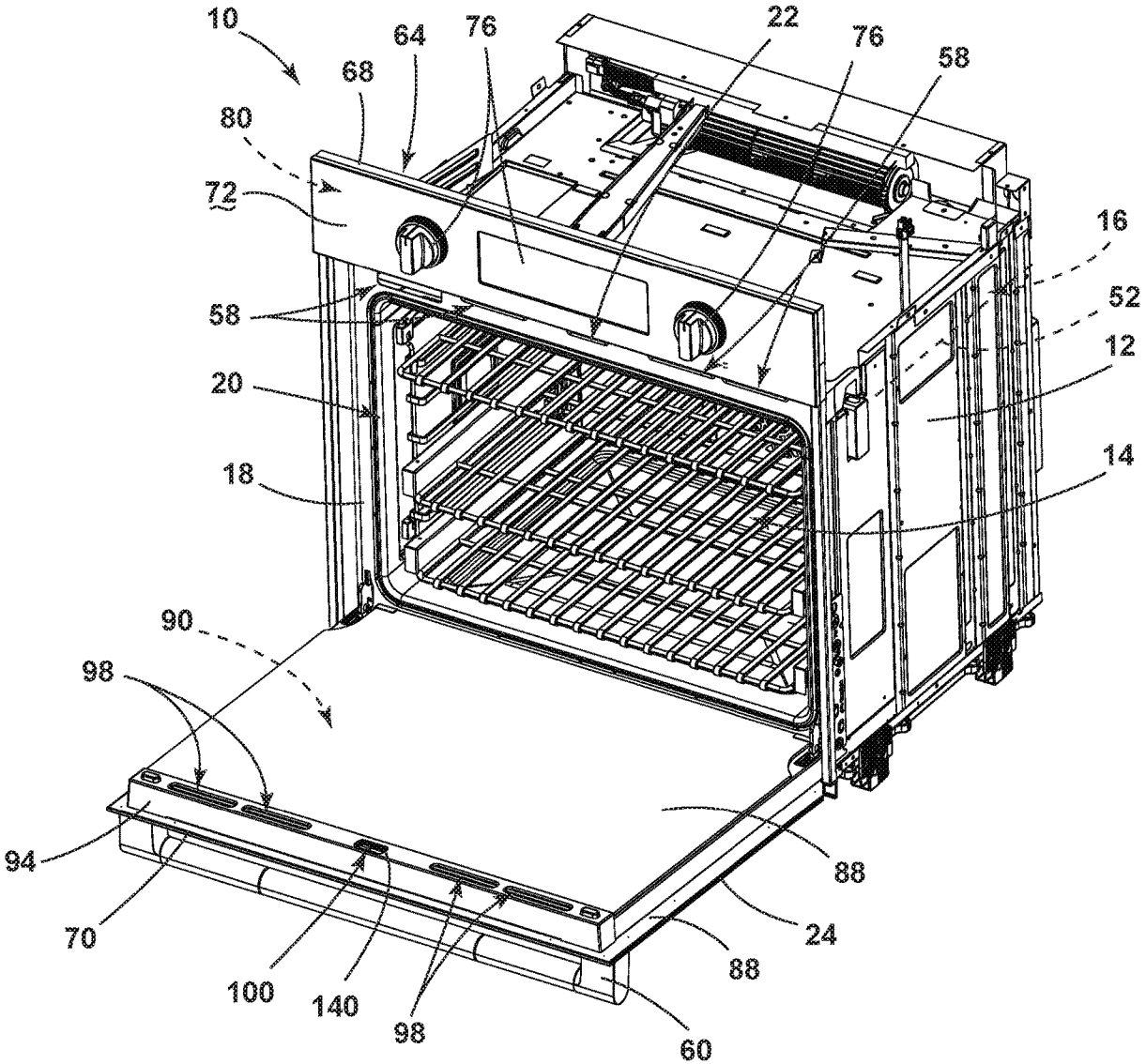
FIG. 3 is a top perspective view of the cooking appliance of FIG. 1 with a door in an open position.

Referring now to FIGS. 1-3, the appliance 10 is illustrated with the door 24 in a closed position (FIG. 1), an intermediate position (FIG. 2), and an open position (FIG. 3). As previously introduced, the cabinet 12 of the appliance 10 defines the first and second compartments 14, 16. In the illustrated embodiment, the first compartment 14 is configured and referred to as a cooking compartment 14, and the second compartment 16 is configured and referred to as an upper compartment 16. However, it will be understood that the first and second compartments 14, 16 may be any compartments defined by the cabinet 12 and may be oriented in any position (e.g., the first compartment 14 may be positioned above the second compartment 16, the second compartment may be positioned forward of the first compartment 14, etc.) without departing from the scope of the present disclosure.

A cooking compartment liner 50 defines the cooking compartment 14 within the cabinet 12. The cooking compartment liner 50 may be coupled with the front panel 18 of the cabinet 12 to align the cooking compartment 14 with the access opening 20. In various examples, the liner 50 may separate the cooking compartment 14 from the upper compartment 16. In other examples, the cabinet 12 may further include an upper wall 52 positioned between the liner 50 and at least partially defining the upper compartment 16, as described in more detail elsewhere herein.

As introduced above, the front panel 18 is coupled with the cabinet 12 and at least partially conceals the upper compartment 16. The front panel 18 defines the access opening 20 in communication with the cooking compartment 14 and further defines the latch opening 22 in communication with the upper compartment 16. The latch opening 22 may be defined between an upper edge 54 of the front panel 18 and the access opening 20 and is disposed through the front panel 18 of the cabinet 12. However, it is contemplated that the latch opening 22 may be defined in any position or location configured to allow the latch assembly 26 to couple the door 24 in the closed position, without departing from the scope of the present disclosure. For example, the latch opening 22 may be defined proximate the center of the upper edge 54 of the front panel 18 or may be defined proximate a side edges of the front panel 18.

As illustrated in FIGS. 2 and 3, the latch opening 22 may be defined proximate a plurality of vent openings 58 defined by the front panel 18 to provide air flow to the upper compartment 16. The plurality of vent openings 58 may be configured to promote air flow through the upper compartment 16, as discussed in more detail elsewhere herein. Each of the plurality of vent openings 58 may be generally rectangular, and the plurality of vent openings 58 may be arranged linearly along the upper edge 54 of the front panel 18. The latch opening 22 may be defined to be aligned with the plurality of vent openings 58. The latch opening 22 may be the same size as each of the plurality of vent openings 58 or may have a different size and shape compared to the vent openings 58. For example, the latch opening 22 may be substantially rectangular, as illustrated, or may have any other shape configured to allow the latch member 28 to extend through the latch opening 22.

Referring still to FIGS. 1-3, the door 24 is hingedly coupled with the cabinet 12 and is movable between the closed position (FIG. 1) and the open position (FIG. 3). A handle 60 is coupled with the door 24 to allow a user to move the door 24 between the open and closed positions. When the door 24 is in the closed position, the door 24 is configured to selectively seal the cooking compartment 14 and conceals the cover plate 30 and the latch opening 22. When the door 24 is in the open position, the cooking compartment 14 is accessible through the access opening 20 defined by the front panel 18 and the cover plate 30 is visible. When the door 24 is in the open position, the cover plate 30 is biased into an obstructed position and is configured to selectively conceal and/or fill the latch opening 22. The cover plate 30 may be sized to only partially cover the latch opening 22 or may be sized to fill the entirety of the latch opening 22.

A control panel assembly 64 is positioned above the front panel 18 and includes a housing 68. The housing 68 extends forward of the front panel 18 and forms a forward upper edge of the cabinet 12 that extends over a top edge 70 of the door 24 when the door 24 is in the closed position. The housing 68 of the control panel assembly 64 may be operably coupled with the cabinet 12 or may be integrally formed with the cabinet 12. A front surface 72 of the housing 68 is oriented to be substantially co-planar with a front surface of the door 24 when the door 24 is in the closed position. The control panel assembly 64 further includes a plurality of user inputs 76 positioned on the front surface 72 of the housing 68. The user inputs 76 may include knobs, a touch display, or any other user input capable of providing instructions regarding the operation of the appliance 10 without departing from the scope of the present disclosure.

The housing 68 of the control panel assembly 64 defines an electronics cavity 80 configured to house various electronic components of the appliance 10 (e.g., electrical connections for the user inputs 76). The electronics cavity 80 may be in communication with the upper compartment 16 of the cabinet 12 or may be defined separately from the upper compartment 16. As discussed in more detail elsewhere herein, the electronics cavity 80 may further house the proximity sensor 32.

Referring now to FIG. 3, the door 24 includes a plurality of panels 88 defining an interior space 90 of the door 24. A top frame member 94 extends across the door 24 proximate the top edge 70 of the door 24. The top frame member 94 may be configured to couple the plurality of panels 88 to form the door 24 and further defines the interior space 90.

For example, the top frame member 94 may be shaped as a rectangular cap configured to fit over top edges of one or more of the plurality of panels 88.

The top frame member 94 defines a plurality door vents 98 configured to be aligned with the plurality of vent openings 58 of the front panel 18 when the door 24 is in the closed position. The plurality of door vents 98 may be configured to place the interior space 90 of the door 24 in communication with the upper compartment 16 and may direct air through the door 24 and the upper compartment 16.

The top frame member 94 further defines a latch receiving aperture 100 proximate the top edge 70 of the door 24. The latch receiving aperture 100 may have a similar size and shape to the size and shape of the latch opening 22 or may have a different size and shape compared to the latch opening 22. When the door 24 is in the closed position, the latch receiving aperture 100 is configured to align with the latch opening 22, as discussed elsewhere herein.

Figure 4A:
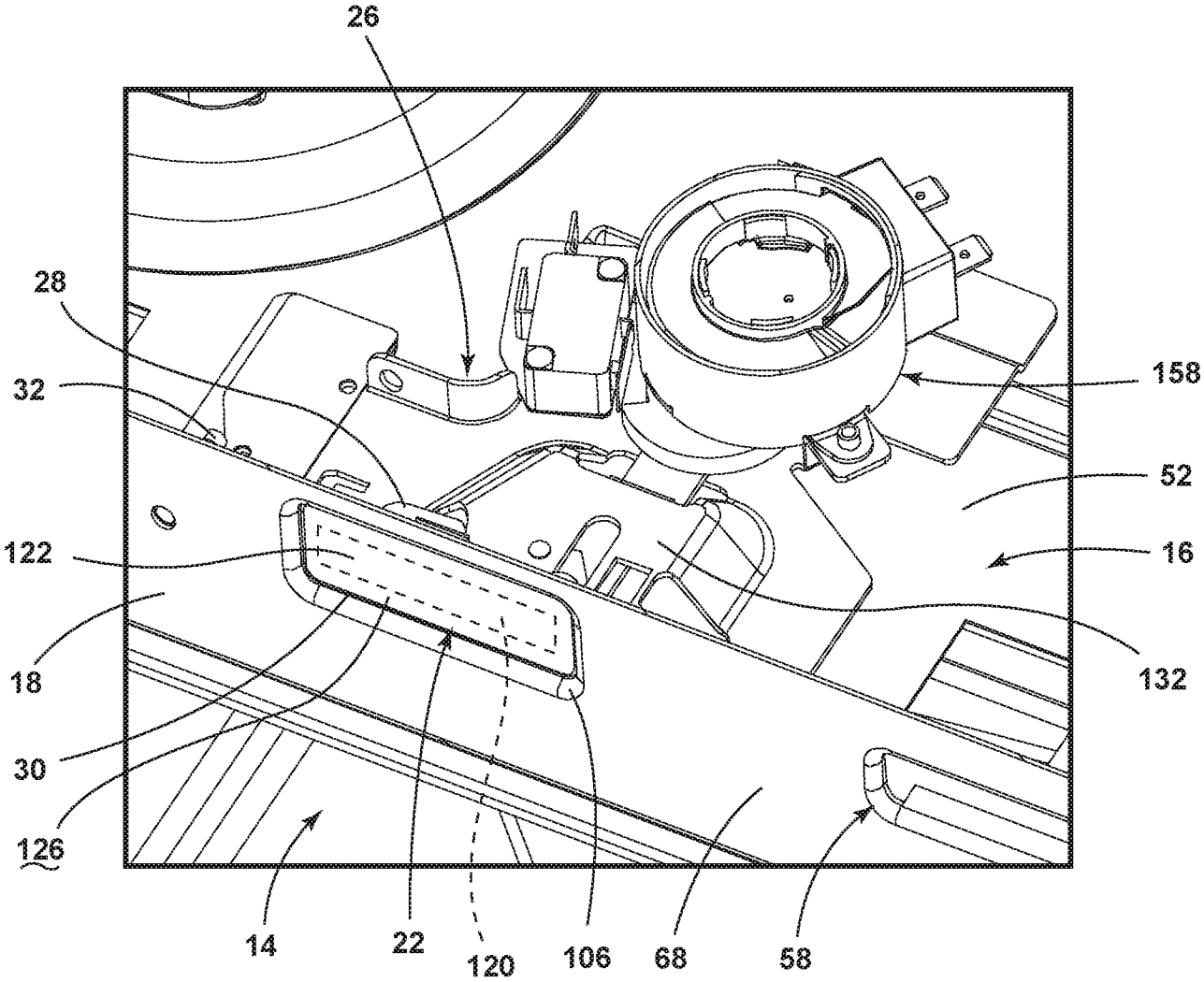
FIG. 4A is a front perspective view of a front panel of the cooking appliance of FIG. 1 with a cover concealing a latch opening and a latch assembly in a first position.
Figure 4B:
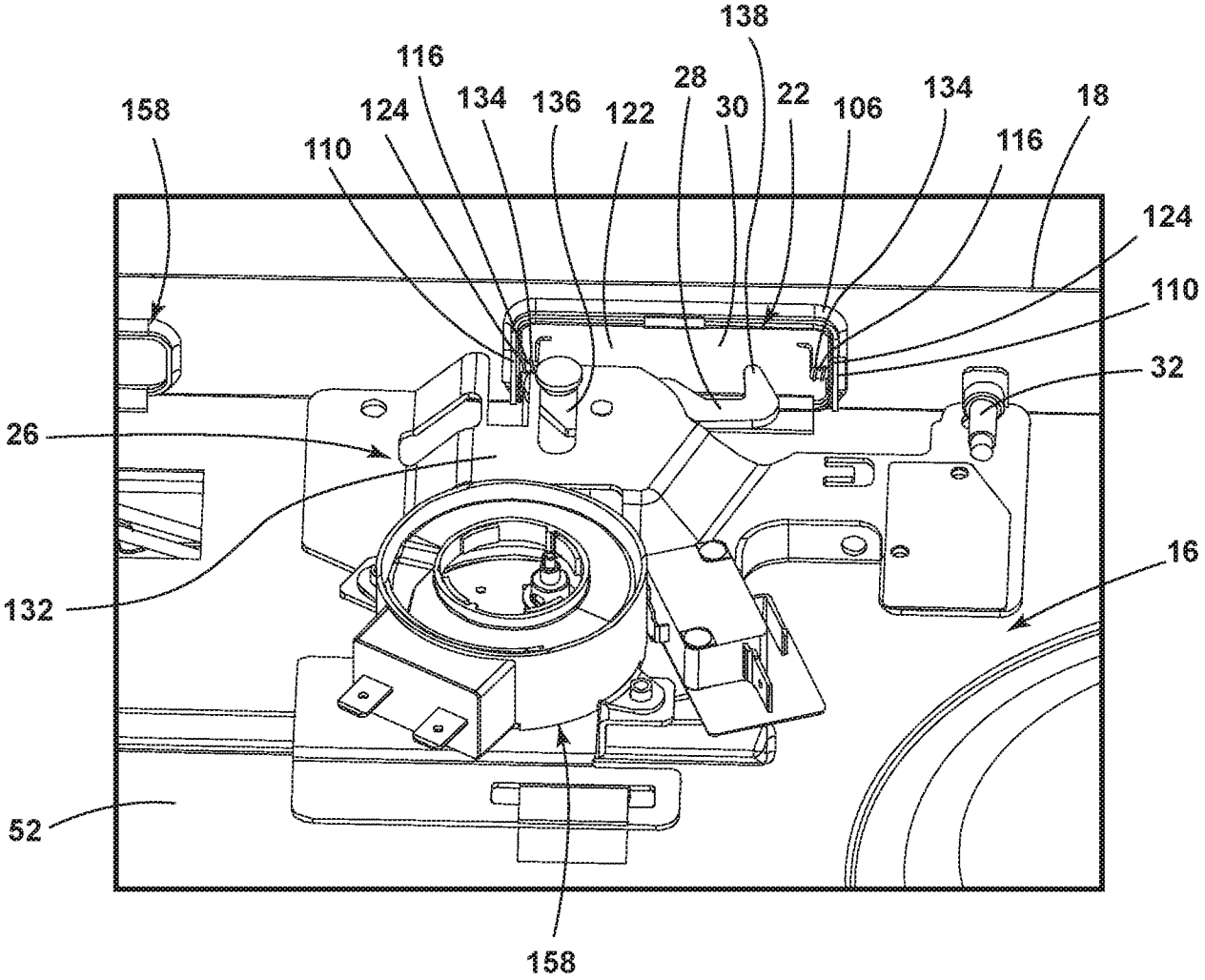
FIG. 4B is a rear perspective view of the front panel of the cooking appliance, latch opening, and latch assembly of FIG. 4A.

Referring now to FIGS. 4A and 4B, an enlarged view of the front panel 18 is illustrated with the cover plate 30 in an obstructed position. The cover plate 30 is rotatably coupled with the front panel 18 of the cabinet 12 at the latch opening 22 and is movable between the obstructed position (FIGS. 4A and 4B) and an unobstructed position (FIGS. 5A and 5B). When the cover plate 30 is in the obstructed position, the cover plate 30 covers and/or obstructs the latch opening 22 and may prevent access to the latch assembly 26. When the cover plate 30 is in the unobstructed position, the latch member 28 of the latch assembly 26 may be positioned through the latch opening 22.

The latch opening 22 is defined by an inner edge 106 of the front panel 18. The inner edge 106 may be generally beveled inward or may be substantially coplanar with the front panel 18. As best shown in FIG. 4B, the inner edge 106 may extend rearward of the front panel 18 into the upper compartment 16. The inner edge 106 may include a pair of extensions 110 protruding from the inner edge 106 into the upper compartment 16 on opposing sides of the latch opening 22. Each extension 110 defines a receiving well 114 configured to receive a rotation pin 116. The rotation pin 116 may be a single rotation pin 116 extending between the extensions 110 or may be one of a pair of rotation pins 116. Each extension 110 and rotation pin 116 is configured to provide a pivot for the cover plate 30 such that the cover plate 30 rotates above the pins 116 when the cover plate 30 is moved between the obstruction position and the unobstructed position.

As illustrated in FIGS. 4A and 4B, the cover plate 30 includes a plate body 122 configured to fully obstruct the latch opening 22 when the cover plate 30 is in the obstructed position. In various examples, the plate body 122 may have a size and shape selected to complement and be received within the latch opening 22. In other examples, the plate body 122 may be smaller or larger than the latch opening 22 without departing from the scope of the present disclosure. The plate body 122 may further include indicia 120 positioned on an outer surface 126 of the plate body 122 and configured to be visible when the door 24 is in the open position and the cover plate 30 obstructs the latch opening 22 (FIG. 4A).

As best shown in FIG. 4B, a pair of arms 124 extends from opposing sides of the cover plate 30 and corresponds with the pair of extensions 100 of the inner edge 106. The pair of arms 124 may be integrally formed with the plate body 122 of the cover plate 30. In various examples, the pair of arms 124 operates as the rotation pins 116 to couple the cover plate 30 with the front panel 18 of the appliance 10. In other examples, each of the pair of arms 124 is substantially planar. Each of the arms 124 may be configured to be coupled with the respective rotation pin 116. For example, the pair of arms 124 may define receiving spaces, through-holes, or any other engagement feature configured to rotatably couple the pair of arms 124 with the rotation pins 116 when the rotation pins 116 are positioned through the receiving well 114 and coupled with one of the pair of arms 124 to rotatably couple the cover plate 30 within the latch opening 22.

A spring 134 is positioned on one or both of the rotation pins 116 and is configured to bias the cover plate 30 into the obstructed position. As illustrated, the spring 134 may be a torsion spring that abuts the extension 110 proximate the spring 134 and the respective rotation pin 116 and the plate body 122 of the cover plate 30. However, it will be understood that the spring 134 may be any type of spring configured to bias the cover plate 30 towards the obstructed position. It is further contemplated that the cover plate 30 may be gravity biased towards the obstructed position without the use of the spring 134 without departing from the scope of the present disclosure.

Referring now to FIGS. 4B-5B, the latch assembly 26 is positioned within the upper compartment 16 rearward of the latch opening 22. In various examples, the latch assembly 26 may be supported by the upper wall 52 of the cabinet 12. In other examples, the latch assembly 26 may be supported by a liner or other surface positioned to orient the latch assembly 26 to align with the latch opening 22 of the front panel 18.

The latch assembly 26 includes the latch member 28 positioned proximate and aligned with the latch opening 22 and operably coupled with a latch plate 132. The latch member 28 includes a stem portion 136 operably coupled with the latch plate 132. In various examples, the stem portion 136 may be rotatably coupled with the latch plate 132 such that the latch member 28 rotates through the latch opening 22 when the latch member is moved from the disengaged position to the engaged position. In other examples, the stem portion 136 maybe slidably coupled with the latch plate 132 such that the latch member 28 slides through the latch opening 22 when the latch member is moved from the disengaged position to the engaged position.

The latch member 28 may further include a head portion 138 extending from the stem portion 136 and configured to be moved through the latch opening 22 when the latch member 28 moves from the engaged position to the disengaged position. In various examples, the head portion 138 may be integrally formed with the stem portion 136 as a single piece. As illustrated, the head portion 138 may extend from the stem portion 136 such that the latch member 28 is shaped like a hook. However, it is contemplated that the latch member 28 may have any shape configured to retain the door 24 when the door 24 is in the closed position, as discussed elsewhere herein.

The stem portion 136 of the latch member 28 is sized such that the head portion 138 is movable through the latch opening 22 as the latch member 28 is moved from the disengaged position (FIG. 4B) to the engaged position (FIGS. 5A and 5B). The stem portion 136 may further be sized to partially extend through at least the latch opening 22 when the latch member 28 is in the engaged position. The stem portion 136 may also be sized to extend between the front panel 18 and the door 24 to position the head portion 138 to extend through the latch receiving aperture 100 of the door 24 when the latch member 28 is in the engaged position.

When the latch member 28 is moved from the disengaged position into the engaged position, the head portion 138 of the latch member 28 is configured to contact the cover plate 30 and rotate the cover plate 30 from the obstructed position into the unobstructed position. In other words, the head portion 138 of the latch member 28 acts against the bias of the spring 134 and urges the cover plate 30 into the unobstructed position. When the cover plate 30 is in the unobstructed position, the plate body 122 of the cover plate 30 may be configured to rest on and/or abut the latch member 28 while the latch member 28 is in the engaged position to retain the cover plate 30 in the unobstructed position. However, it is contemplated that other mechanisms (e.g., a stop) may be used to retain the cover plate 30 in the unobstructed position without departing from the scope of the present disclosure.

Figure 5:
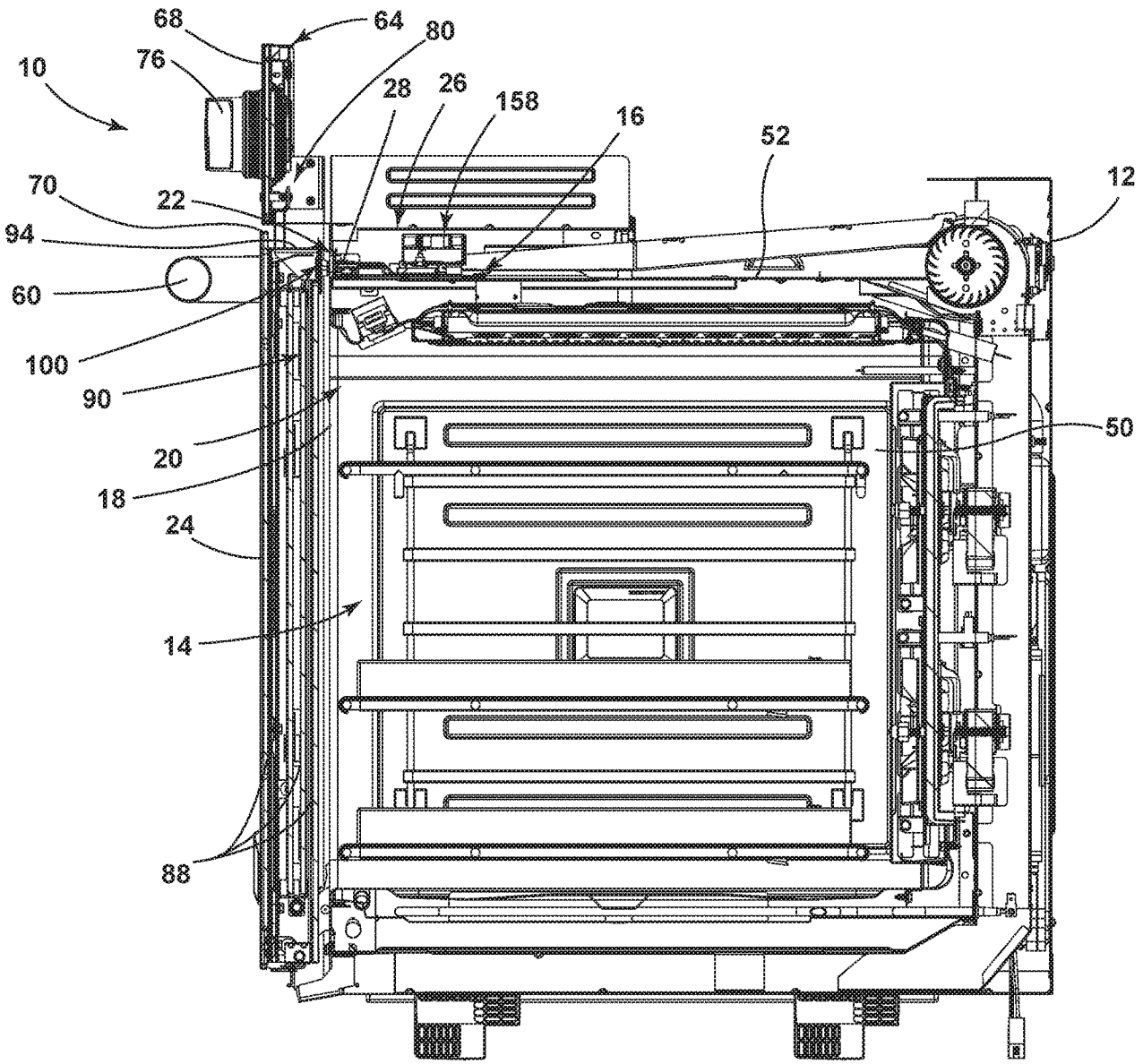
FIG. 5 is a cross-sectional view of the cooking appliance of FIG. 1 taken along line V-V.
Figure 5A:
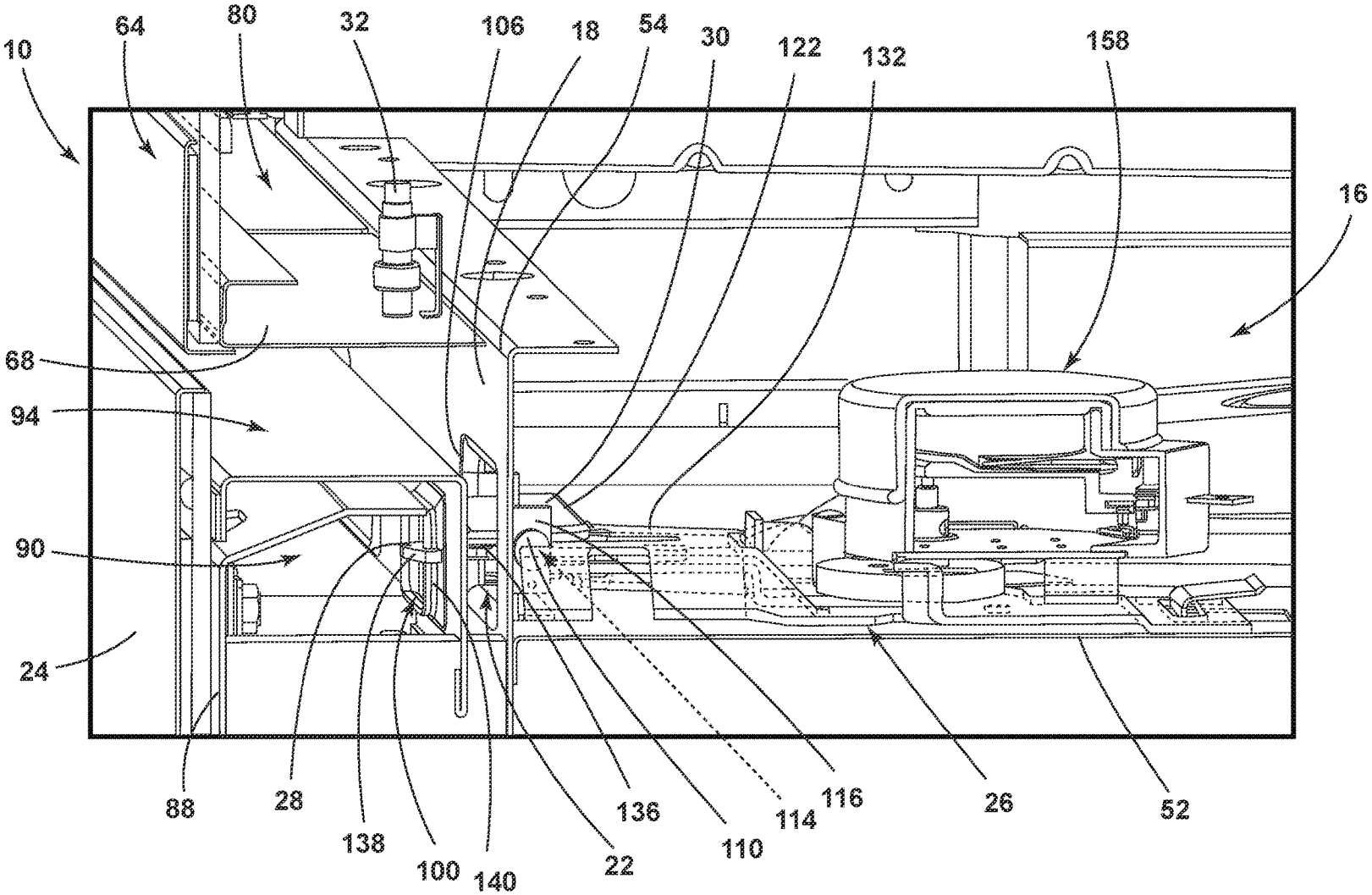
FIG. 5A is an enlarged perspective view of the latch assembly illustrated by the cross-section of FIG. 5.
Figure 5B:
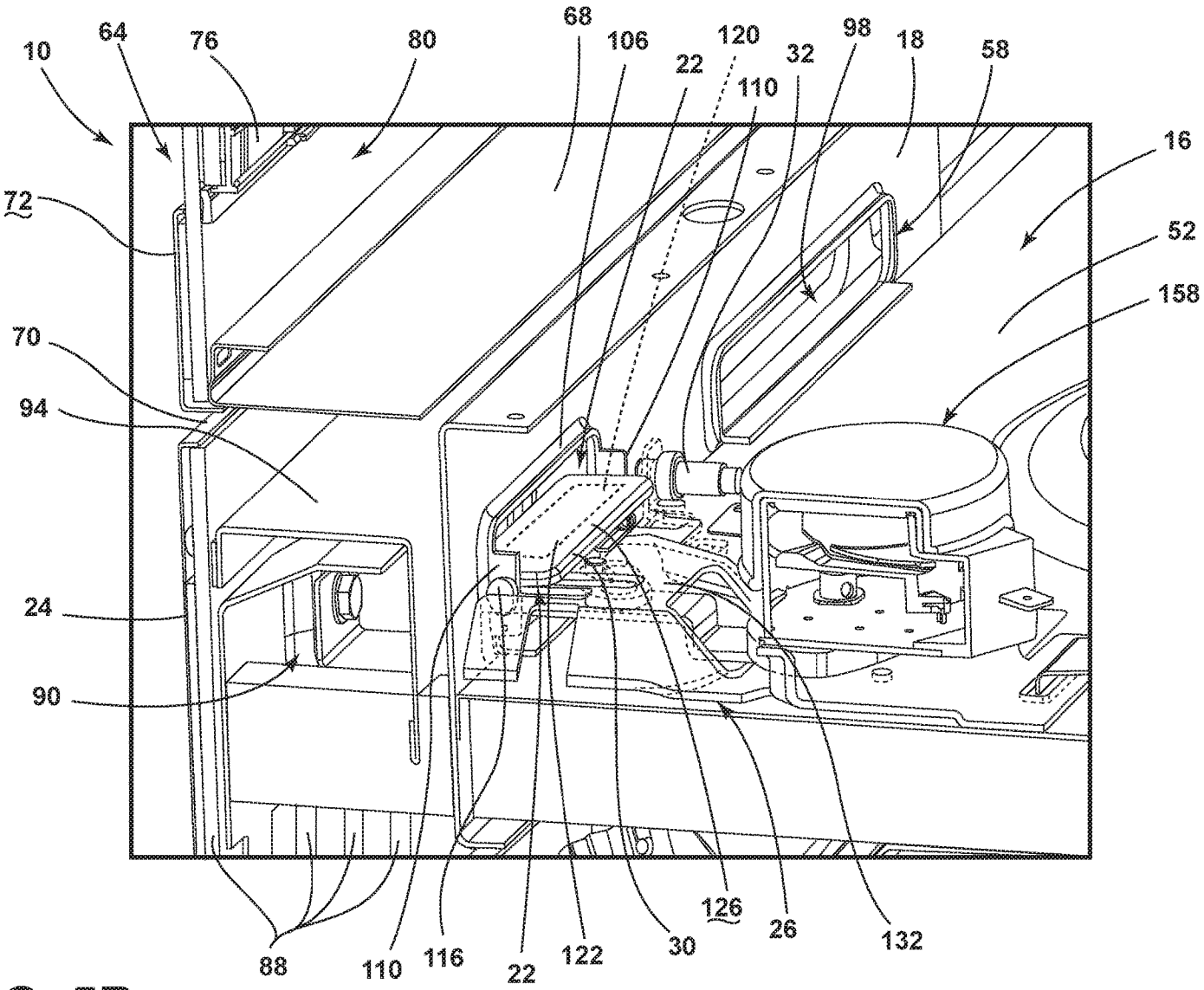
FIG. 5B is a rear perspective view of a latch assembly of an appliance, according to various examples.

Referring now to FIGS. 5-5B, the door 24 is illustrated in the closed position with the latch member 28 in the engaged position. When the door 24 is in the closed position, the latch receiving aperture 100 of the door 24 is aligned with the latch opening 22. As previously discussed, the latch receiving aperture 100 may be shaped to complement the latch opening 22 or may have a different shape and size from the latch opening 22. As illustrated, the latch receiving aperture 100 includes at least one linear edge 140 configured to be engaged by the head portion 138 of the latch member 28 when the latch member 28 is in the engaged position. Where the latch member 28 is shaped as a hook, the head portion 138 of the latch member 28 may wrap around the linear edge 140 as the latch member 28 is moved into the engaged position. In other examples, a striker or other engagement feature may be positioned proximate the latch receiving aperture 100 to be engaged with the latch member 28 without departing from the scope of the present disclosure.

The proximity sensor 32 is positioned proximate the latch assembly 26 and is configured to detect the position of the door 24. The proximity sensor 32 may be positioned within the housing 68 of the control panel assembly 64, as illustrated in FIG. 5A, or the proximity sensor 32 may be positioned within the upper compartment 16 proximate the latch member 28, as illustrated in FIG. 5B. The proximity sensor 32 is configured to detect when the door 24 is in the closed position and is triggered when the door 24 is in the closed position. It will be understood that the proximity sensor 32 may be positioned in any location configured to allow the proximity sensor 32 to detect the position of the door 24 without departing from the scope of the present disclosure.

Figure 6:
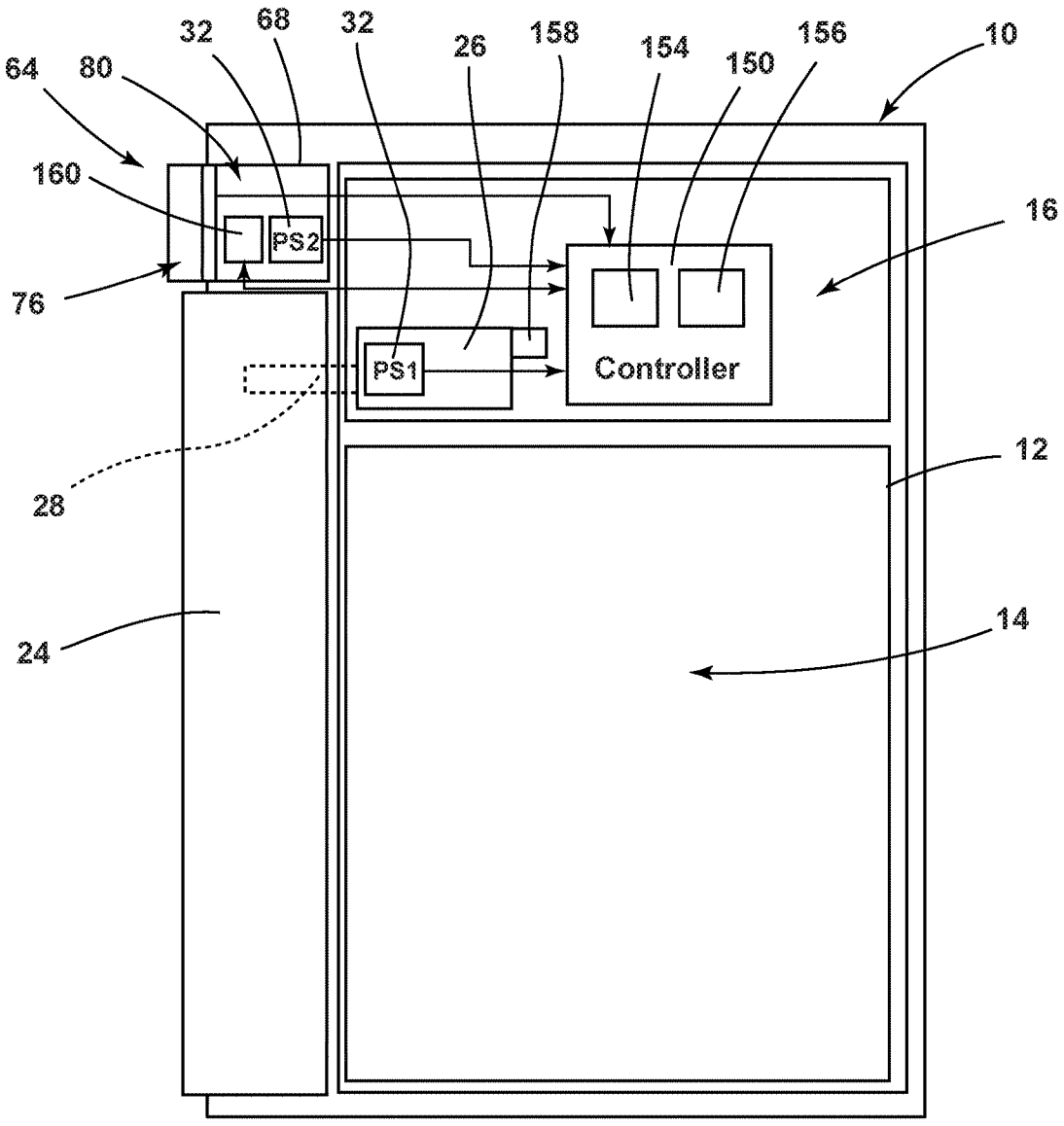
FIG. 6 is a schematic diagram illustrating electrical components of the cooking appliance of FIG. 1.

Referring now to FIG. 6, the appliance 10 and various components are schematically illustrated, including both positions of the proximity sensor 32 (i.e., in the upper compartment 16 as labeled PS1 and in the electronics cavity 80 as labeled PS2). The appliance 10 includes a controller 150 including a processor 154 and memory 156 configured to store instructions. The controller 150 is in communication with and configured to receive input from the user inputs 76 of the control panel assembly 64 and from various sensors of the appliance 10, including the proximity sensor 32. The controller 150 is configured to utilize the input to provide instructions to various other components of the appliance 10, such as, for example, heating elements configured to heat the cooking compartment 14. Where the user inputs 76 includes a display, the controller 150 may further be configured to communicate with the display to show information regarding the appliance 10 (e.g., the state of the door 24 and/or latch assembly 26).

The proximity sensor 32 of the appliance 10 is configured to detect the position of the door 24 and is configured to provide input to the controller 150 regarding the position of the door 24. Specifically, when a user selects a high-heat cycle (e.g., a cleaning cycle) for the appliance 10 using the user inputs 76, the controller 150 is configured to utilize an input from the proximity sensor 32 to determine the position of the door 24 prior to initiating the high-heat cycle. If the door 24 is in the closed position, the controller 150 is configured to actuate an actuation assembly 158 to move the latch member 28 of the latch assembly 26 between the engaged and disengaged positions based on input from the user inputs 76. In other examples, the controller 150 may receive input from a high-heat cycle specific actuator or input 160 positioned proximate the other user inputs 76 of the control panel assembly 64 and may be configured to operate the actuation assembly 158 based on input from the actuator 160. Alternatively, the latch member 28 may be configured to be manually moved into the engaged position by a user via an external actuator.

When the latch member 28 is in the engaged position, and the door 24 is secured in the closed position, the controller 150 is configured to operate the appliance 10 to initiate the high-heat cycle. However, if the proximity sensor 32 detects that the door 24 is not in the closed position (e.g., is in an intermediate position or in the open position), the controller 150 is configured to prevent initiation of the high-heat cycle based on the input from the proximity sensor 32. It is contemplated that the controller 150 may be configured to prevent or limit any operation of the cooking appliance 10, including initiation of various heat cycles, when the door 24 is in the open position without departing from the scope of the present disclosure.

The latch assembly 26 may provide a secure coupling of the door 24 with the cabinet 14 when the door 24 is in the closed position and the latch member 28 of the latch assembly 26 is in the engaged position. The proximity sensor 32 may provide input to the controller 150 to ensure the door 24 is in the closed position before the latch assembly 26 is actuated and the latch member 28 is moved into the engaged position to couple the door 24 with the cabinet 14 and before the controller 150 actuates the high-heat cycle of the appliance 10. The use of the cover plate 30 to conceal the latch member 28 and the latch assembly 26 when the door 24 is not coupled with the cabinet 14 by the latch assembly 26 further provides an aesthetically pleasing appearance for the front panel 18 and the front of the cabinet 14 and may allow the display of indicia 120 (e.g., a logo or other selected image) at the front of the cabinet 14 when the door 24 is open.

According to one aspect, a cooking appliance may include a cabinet defining first and second compartments. A front panel may be coupled with the cabinet. The front panel may define an access opening in communication with the first compartment and a latch opening in communication with the second compartment. A door may be hingedly coupled with the cabinet and may be movable between a closed position and an open position. A latch assembly may be positioned within the second compartment. The latch assembly may include a latch member operable between engaged and disengaged positions. A portion of the latch member may extend through the latch opening when the latch member is in an engaged position. A cover plate may be operably coupled to the front panel at the latch opening and may be movable from a first position to a second position by the latch member when the latch member is moved from the disengaged position to the engaged position.

According to another aspect, a cover plate may be spring biased towards a first position.

According to another aspect, a cover plate may be gravity biased towards a first position.

According to another aspect, a latch member may contact a cover plate to rotate the cover plate from a first position to a second position when the latch member moves from a disengaged position to an engaged position.

According to another aspect, a latch member may engage a latch receiving aperture of a door when the latch member is in an engaged position.

According to another aspect, a cooking appliance may include a proximity sensor positioned proximate the latch assembly and configured to detect the door in the closed position. A controller may be in communication with the proximity sensor and may be configured to selectively actuate an actuation assembly to rotate a latch member into an engaged position based on an input from a proximity sensor.

According to another aspect, a cooking appliance may include a cabinet having a compartment and a front panel. The front panel may include a latch opening disposed therethrough. A door may be hingedly coupled with the cabinet and may define a latch receiving aperture. A latch assembly may be positioned within the compartment and may have a latch member operable between first and second positions. The latch member may extend through the latch opening when the latch member is in a second position. A cover plate may be rotatably coupled with the cabinet and may be configured to selectively obstruct the latch opening.

According to another aspect, a latch receiving aperture may be aligned with a latch opening when a door is in a closed position.

According to another aspect, a latch member may include a stem portion and a head portion. The stem portion of the latch member may extend through a latch opening when the latch member is in a second position. The head portion of the latch member may extend through a latch receiving aperture and may engage with an edge of the latch receiving aperture when the latch member is in the second position.

According to another aspect, a cover plate may include indicia on an outer surface of the cover plate that is visible when the cover plate obstructs the latch opening.

According to another aspect, a cooking appliance may include a control panel assembly coupled to a cabinet and having a housing that extends over a top edge of a door. A proximity sensor may be positioned within the housing.

According to another aspect, a proximity sensor may be positioned proximate an upper edge of a front panel.

According to another aspect, a latch member may urge a cover plate into an unobstructed position from an obstructed position when the latch member moves from in a first position to a second position.

According to another aspect, a latch assembly for an appliance may include a cabinet having a front panel with a latch opening. A latch member may be aligned with the latch opening of the front panel and may be movable between an engaged position and a disengaged position. A door may be hingedly coupled to the cabinet between open and closed positions and may have a latch receiving aperture. A cover plate may be configured to selective cover the latch opening. The cover plate may be rotatably coupled with the cabinet between first and second positions.

According to another aspect, a door may include a linear edge at least partially defining a latch receiving aperture.

According to another aspect, a latch member may engage the linear edge of the door when the latch member is in an engaged position.

According to another aspect, a cover plate may be rotatably coupled with a cabinet by at least one pin.

According to another aspect, a latch assembly may include a spring positioned on at least one pin. The spring may bias a cover plate towards a first position to cover a latch opening.

According to another aspect, a latch assembly may include a proximity sensor configured to detect a door in a closed position. A controller may be in communication with the proximity sensor and may be configured to selectively initiate a high-heat cycle based on an input from the proximity sensor.

According to another aspect, a latch assembly may include an actuation assembly configured to actuate a latch member from a disengaged position to an engaged position when the high-heat cycle is initiated.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cooking appliance, comprising;

a cabinet defining first and second compartments;

a front panel coupled with the cabinet, wherein the front panel defines an access opening in communication with the first compartment and a latch opening in communication with the second compartment, and further wherein the access opening includes an inner edge and first and second extensions protruding inwardly from the inner edge into the upper compartment, wherein the first and second extensions are positioned on opposing sides of the access opening;

a door hingedly coupled with the cabinet and movable between a closed position and an open position;

a latch assembly positioned within the second compartment, wherein the latch assembly includes a latch member operable between engaged and disengaged positions, wherein a portion of the latch member extends through the latch opening when the latch member is in an engaged position;

a cover plate operably coupled to the front panel at the latch opening by first and second rotation pins, wherein the cover plate rotates above the first and second rotation pins from a first position to a second position as urged by the latch member when the latch member is moved from the disengaged position to the engaged position; and a spring mounted on one of the first and second rotation pins, wherein the spring is further coupled to a plate body of the cover plate and further coupled to one of the first and second extensions.

2. The cooking appliance of claim 1, wherein the latch member contacts the cover plate to rotate the cover plate from the first position to the second position when the latch member moves from the disengaged position to the engaged position.

3. The cooking appliance of claim 1, wherein the latch member engages a latch receiving aperture of the door when the latch member is in the engaged position.

4. The cooking appliance of claim 1, including:

a proximity sensor positioned proximate the latch assembly and configured to detect the door in the closed position; and a controller in communication with the proximity sensor and configured to selectively actuate an actuation assembly to rotate the latch member into the engaged position based on an input from the proximity sensor.

5. A cooking appliance, comprising:

a cabinet having a compartment and a front panel, wherein the front panel includes a latch opening disposed therethrough and having first and second extensions protruding inwardly from an inner edge of the latch opening into the compartment;

a door hingedly coupled with the cabinet and defining a latch receiving aperture;

a latch assembly positioned within the compartment and having a latch member operable between first and second positions, wherein the latch member extends through the latch opening when the latch member is in the second position;

a cover plate operably coupled to the front panel at the latch opening by one or more rotation pins, wherein the cover plate rotates above the one or more rotation pins from a first position to a second position as urged by the latch member when the latch member is moved from the first position to the second position; and a spring mounted on one of the first and second rotation pins, wherein the spring is further coupled to a plate body of the cover plate and further coupled to one of the first and second extensions.

6. The cooking appliance of claim 5, wherein the latch receiving aperture is aligned with the latch opening when the door is in a closed position.

7. The cooking appliance of claim 5, wherein the latch member includes a stem portion and a head portion, and further wherein the stem portion of the latch member extends through the latch opening when the latch member is in the second position, and further wherein the head portion of the latch member extends through the latch receiving aperture and engages an edge of the latch receiving aperture.

8. The cooking appliance of claim 5, wherein the cover plate includes indicia on an outer surface of the cover plate that is visible when the cover plate obstructs the latch opening.

9. The cooking appliance of claim 5, including:

a control panel assembly coupled to the cabinet and having a housing that extends over a top edge of the door; and a proximity sensor is positioned within the housing.

10. The cooking appliance of claim 5, wherein the proximity sensor is positioned proximate an upper edge of the front panel.

11. The cooking appliance of claim 5, wherein the latch member urges the cover plate into an unobstructed position from an obstructed position when the latch member moves from the first position to the second position.

* * * * *